US007475523B2

(12) United States Patent
Graushar et al.

(10) Patent No.: US 7,475,523 B2
(45) **Date of Patent: *Jan. 13, 2009**

(54) SELECTIVE PRODUCT INSERTER PROCESS

(75) Inventors: William T. Graushar, Elm Grove, WI (US); Eric Blohm, West Allis, WI (US)

(73) Assignee: Quad/Graphics, Inc., Sussex, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/953,456

(22) Filed: Dec. 10, 2007

(65) Prior Publication Data

US 2008/0088075 A1 Apr. 17, 2008

Related U.S. Application Data

(63) Continuation of application No. 11/159,713, filed on Jun. 23, 2005, now Pat. No. 7,325,375.

(60) Provisional application No. 60/582,137, filed on Jun. 23, 2004.

(51) Int. Cl.
*B65B 5/08* (2006.01)
*B65B 57/00* (2006.01)

(52) U.S. Cl. ..... 53/397; 53/445; 53/474; 53/55; 53/155; 53/238; 53/251; 270/1.02; 270/52.02; 700/220; 700/223

(58) Field of Classification Search ..... 53/396, 53/397, 445, 449, 474, 55, 58, 154, 155, 53/237, 238, 240, 249–251; 270/52.02, 52.03, 270/52.16, 52.19, 52.22, 1.02, 1.03; 700/219–224
See application file for complete search history.

(56) References Cited

U.S. PATENT DOCUMENTS 2,251,943 A 8/1941 Kleineberg
3,002,746 A 10/1961 Lloyd et al.
3,049,845 A 8/1962 Hanson
3,059,391 A 10/1962 Volks et al.
3,130,966 A 4/1964 Hepp
3,365,158 A 1/1968 Dowling
3,809,385 A 5/1974 Rana
3,819,173 A 6/1974 Anderson
3,983,679 A 10/1976 Zemke
4,022,455 A 5/1977 Newsome et al.
4,121,818 A 10/1978 Riley et al.
4,149,711 A 4/1979 Jackson
4,177,979 A 12/1979 Orsinger et al.
4,236,706 A 12/1980 Schlough
4,247,092 A 1/1981 Dwyer
4,338,768 A 7/1982 Ballestrazzi et al.
4,395,031 A 7/1983 Gruber et al.

(Continued)

FOREIGN PATENT DOCUMENTS

GB 2228913 9/1990

*Primary Examiner*—Stephen F Gerrity
(74) *Attorney, Agent, or Firm*—Michael Best & Friedrich LLP

(57) ABSTRACT

A process to merge a plurality of streams of printed products. The process includes merging a first stream of printed products with a second stream of printed products according to a predetermined order that is recipient-based, and packaging selected printed products from the first stream while the printed products of the first stream are being merged with the second stream.

11 Claims, 3 Drawing Sheets

U.S. PATENT DOCUMENTS 4,484,733 A 11/1984 Loos et al.
4,576,370 A 3/1986 Jackson
4,683,708 A 8/1987 Linder
4,754,959 A 7/1988 Kobler et al.
4,789,147 A 12/1988 Berger et al.
4,790,119 A 12/1988 McDaniels
4,805,384 A 2/1989 DePasquale et al.
4,829,443 A * 5/1989 Pintsov et al. ..... 705/406
4,831,809 A 5/1989 Ballestrazzi et al.
4,903,600 A 2/1990 Long
4,959,795 A 9/1990 Christensen et al.
4,972,655 A * 11/1990 Ogawa ..... 53/155
4,974,823 A 12/1990 Ishiguro et al.
4,989,850 A 2/1991 Weller
5,005,815 A 4/1991 Auksi
5,083,281 A 1/1992 Rabindran et al.
5,100,116 A 3/1992 Graushar
5,102,110 A 4/1992 Reynolds
5,144,562 A 9/1992 Stikkelorum et al.
5,203,549 A 4/1993 Bryson, Sr. et al.
5,207,412 A 5/1993 Coons, Jr. et al.
5,216,442 A 6/1993 Parks et al.
5,220,770 A 6/1993 Szewczyk et al.
5,268,849 A 12/1993 Howlett et al.
5,285,620 A 2/1994 Kaye et al.
5,346,196 A 9/1994 Nussbaum et al.
5,413,321 A 5/1995 Banks et al.
5,414,974 A 5/1995 Van de Ven et al.
5,437,143 A 8/1995 Culpepper et al.
5,445,367 A 8/1995 Long
5,467,973 A 11/1995 Graushar et al.
5,538,232 A 7/1996 Long
5,547,175 A 8/1996 Graushar et al.
5,555,703 A 9/1996 Gombault et al.
5,568,717 A 10/1996 Harrod
5,595,379 A 1/1997 Hoang
5,628,249 A 5/1997 Cordery et al.
5,634,633 A 6/1997 Graushar
5,640,831 A 6/1997 Harrod et al.
5,645,387 A 7/1997 Scalet et al.
5,678,813 A 10/1997 Osako et al.
5,706,632 A 1/1998 Kivits et al.
5,720,157 A 2/1998 Ross
5,806,842 A 9/1998 Steinhilber et al.
5,810,345 A 9/1998 Lehmann et al.
5,816,773 A 10/1998 Fehringer et al.
5,820,325 A 10/1998 Hartsoe
5,820,334 A 10/1998 Darcy et al.
5,838,574 A 11/1998 Olson et al.
5,921,538 A 7/1999 Schlough
5,988,620 A 11/1999 Graushar
6,019,047 A 2/2000 Klaas et al.
6,167,326 A 12/2000 Graushar et al.
6,182,422 B1 2/2001 Andersen et al.
6,213,456 B1 4/2001 Hirano et al.
6,217,271 B1 4/2001 Latvakangas et al.
6,237,908 B1 5/2001 Chang et al.
6,257,566 B1 7/2001 Dooley
6,267,366 B1 7/2001 Graushar et al.
6,269,609 B2 8/2001 Graushar et al.
7,096,088 B2 8/2006 Graushar et al.
7,102,095 B2 9/2006 Blohm
7,325,375 B2 * 2/2008 Graushar et al. ..... 53/397
2003/0062293 A1 4/2003 Graushar et al.
2003/0081223 A1 5/2003 Panunto et al.
2003/0093179 A1 5/2003 Blohm
2004/0211709 A1 10/2004 Hanson et al.
2005/0097866 A1 5/2005 Hudetz

* cited by examiner

SELECTIVE PRODUCT INSERTER PROCESS

RELATED APPLICATIONS

This application is a continuation of U.S. Application No. 11/159,713filed Jun. 23, 2005, issued on Feb. 5, 2008 as U.S. Pat. No. 7,325,375,which claims the benefit of U.S. Provisional Application No. 60/582,137,filed on Jun. 23, 2004. The entire contents of these applications are incorporated by reference herein.

BACKGROUND

Costs associated with the U.S. Postal Service are climbing. Publishers and printers are continually looking for ways to reduce postage costs.

SUMMARY

In one embodiment, the invention is directed to a process to merge a plurality of streams of printed products. The process includes merging a first stream of printed products with a second stream of printed products according to a predetermined order that is recipient-based, and packaging selected printed products from the first stream while the printed products of the first stream are being merged with the second stream.

In another embodiment, the invention is directed to a process including generating a first stream of printed products in a first path, generating a second stream of printed products in a second path, using recipient-based information to selectively feed a packaging device onto the second path that corresponds to a selected printed product in the first path, and merging the first stream and the second stream wherein the selected printed product from the first stream is positioned into the respective packaging device.

In yet another embodiment, the invention is directed to an apparatus for combining streams of printed products. The apparatus includes a first transporter to transport a first stream of printed products, a second transporter to transport a second stream of printed products, a feeder to deliver packaging devices onto the second transporter, a controller comprising an electronic file having therein a sequence order, and a combination area where the first stream is merged into the second stream according to the sequence order and where selected products in the first stream are positioned into a respective packaging device. The sequence order includes recipient-based information.

In another embodiment, the invention is directed to an apparatus including a first transporter to transport a first stream of printed products, a second transporter to transport a second stream of printed products, a feeder to deliver packaging devices onto the second transporter, and a combination area where the first stream is merged into the second stream according to a recipient-based order and where selected products in the first stream are positioned into a respective packaging device.

Other independent features and independent advantages of the invention will become apparent to those of ordinary skill in the art upon review of the following drawing and detailed description.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
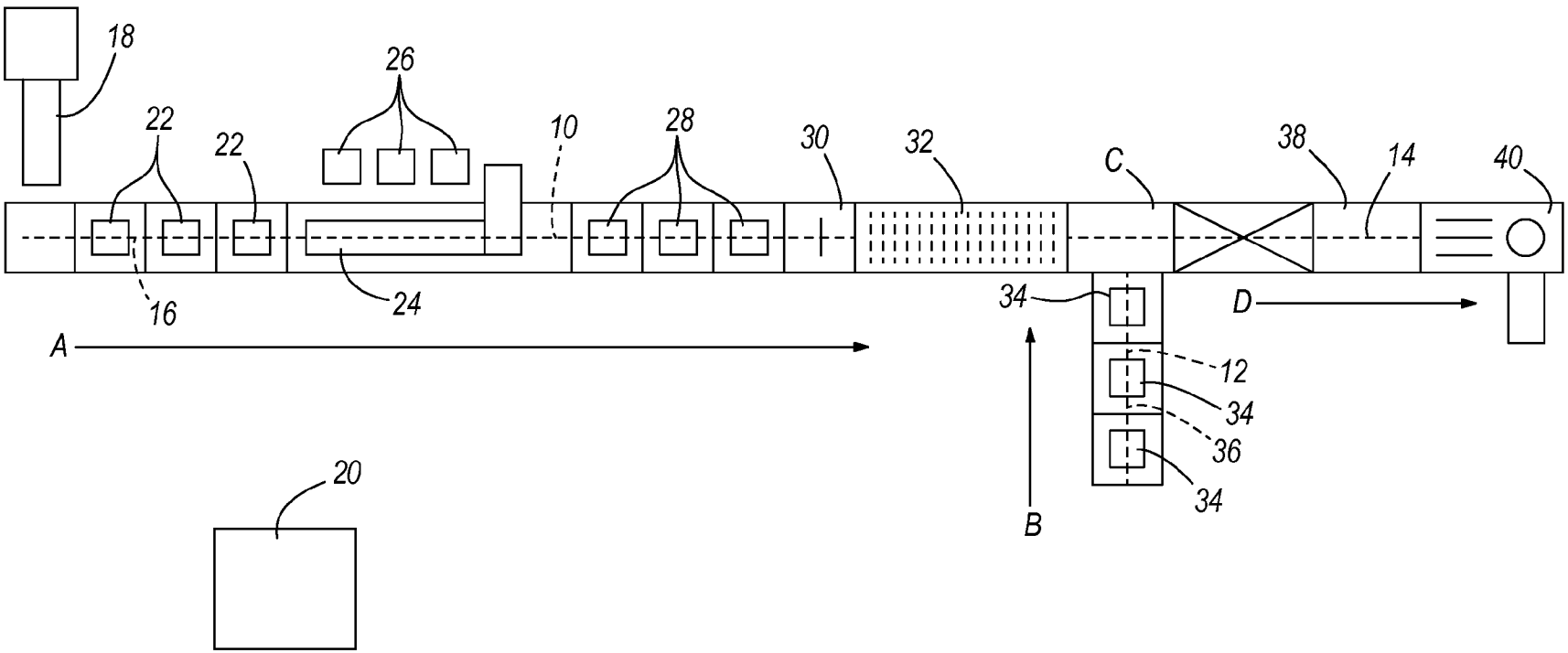
FIG. 1 is a schematic of a process and apparatus embodying the invention.

Referring now to FIG. 1, there is shown an apparatus and process for co-mailing two streams of products. Briefly, a first mail stream of products 10 travels along path A and a separate, second mail stream of products 12 travels along path B. The two paths A and B converge at point C wherein the two streams are combined into a single or third mail stream 14 that thereafter travels along path D.

More specifically, the first mail stream of products 10 preferably is a stream of printed products that are wrapped. In addition to being wrapped, individual products may include components that are insertable into an envelope, with the envelope being wrapped along with the product. The components can include pieces printed inline or offline or not printed at all such as CD-ROM's, or other electronic media. As an example, the component could be a personalized subscriber invoice laser printed off-line and fed to a gathering chain or conveyor 16 on path A via a feeder 18. This first component preferably would include thereon a code such as a bar code, human readable numbers or some type of printed indicia with such code being used to communicate to a controller 20 a sequence number on the component such that a correct product will be matched with the component before wrapping. The sequence number on the first component is read and communicated to the controller 20. The controller 20 then controls feeders 22 that selectively feed other components or inserts onto the gathering chain 16. The first component is therefore matched with the selectively fed subsequent components. The first and subsequent components are then inserted into an envelope by an envelope inserter 24. Preferably, there is more than one feeder 26 of envelopes. The controller 20 controls which envelope type is fed to the gathering chain 16 for insertion of all components.

The envelope containing the one or more components continues on the gathering chain 16 to the feeders 28. The feeders 28 selectively feed unwrapped products onto the gathering chain 16 as controlled by the controller 20. Each product fed to the gathering chain 16 therefore matches up with any associated envelope and its contents. The envelope and matched product continue down the gathering chain 16 and are wrapped together by a conventional wrapper 30. The wrapper material may be paper or poly or any other suitable material. The wrapped products then enter an accumulator 32 where they are stored until they are fed on demand as is described next.

Turning now to the second mail stream 12, products that have not and will not be wrapped are fed from hoppers 34 onto a gathering chain 36 to form path B. The products are then conveyed to station or combination area C. At station C, the first mail stream 10 and the second mail stream 12 are combined to form a single or third mail stream 14 in a predetermined order. That predetermined order is derived from a master sequence or master mailing list known to the controller 20. For example, the sequence can be in zip code or other address-related order. The controller 20 commands the hoppers 34 to begin feeding products in sequence to the gathering chain 36. The stream however is designed to have gaps or holes in it through the sequence as controlled by the controller 20.

The wrapped products from the first stream 10 are fed on demand from the accumulator 32 into the appropriate gaps as controlled by the controller 20 to produce a combined stream of products in the predetermined sequence of the master list. With the use of the accumulator 32, if there is a problem with the feeders 22 or 26 upstream, the process of combining the first and second mail streams 10 and 12 can continue as long as there is product in the accumulator 32, giving an operator time to fix any upstream problem before the whole co-mailing line has to be stopped for maintenance.

After the first and second mail streams 10 and 12 are combined at the station C, the combined or third mail stream 14 is conveyed to an optional ink jet area 38 where address or other indicia can be selectively printed on the products and then conveyed to a conventional stacker 40 for further conventional processing.

The titles of the products of the first and second mail stream can be different, and similarly, the titles within a mail stream, first or second, can be different. The products can include magazines, books, brochures, direct mail pieces, other printed products and the like.

Figure 2:
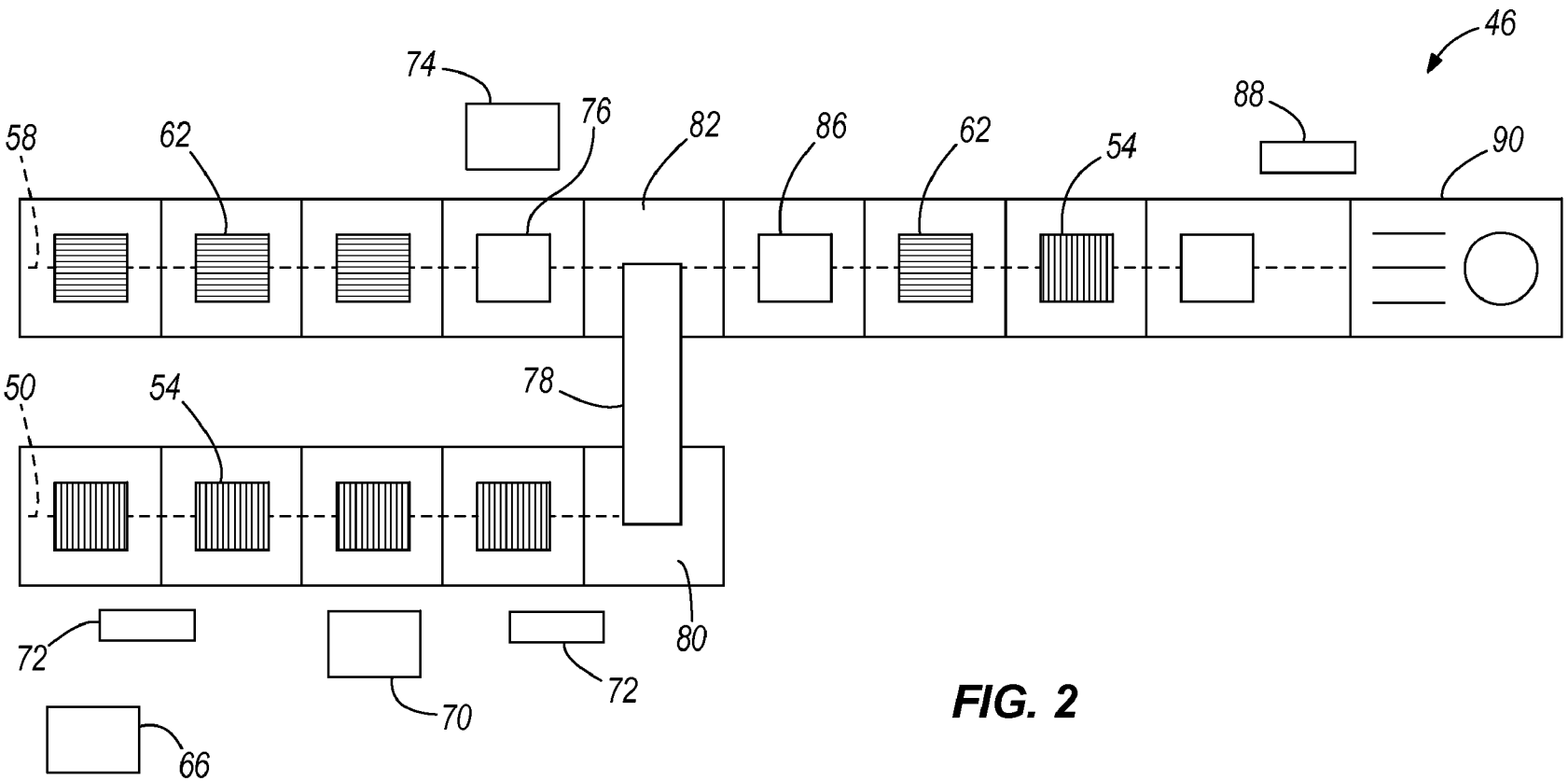
FIG. 2 is a schematic of a process and apparatus embodying the invention.

Referring to FIG. 2 and another embodiment of the invention, an apparatus or finishing line 46 combines two streams of products. The apparatus 46 includes a first conveyor 50 that receives and transports a first stream of products 54 and a second conveyor 58 that transports a second stream of products 62. The products 54, 62 can include magazines, books, brochures, direct mail pieces, other printed products and the like. The products 54, 62 can be the same or different products, and the products within each stream can vary.

The apparatus 46 includes a controller 66, which receives an electronic file, e.g., mailing or sequence list, of all recipients of the products 54, 62. The electronic file is generated by combining the mailing lists of each stream of products 54, 62. The electronic file is in a predetermined order, such as zip code order or other delivery or manufacturing order.

A feeder 70 is positioned near the conveyor 50. The feeder 70, under the control of a controller 66, can selectively feed an insert, a component, or any other type of printed or non-printed printed product (collectively referred to as "insert") onto the conveyor 50. The insert is matched to the appropriate product 54, and both insert and product 54 travel together down the conveyor 50.

The apparatus 46 can include an inkjet printer 72 upstream and/or downstream of the feeder 70. The inkjet printer 72 can selectively print address or other indicia on the products 54 and/or inserts.

The apparatus 46 includes a feeder 74 positioned near the conveyor 58 to selectively package the products 54. The feeder 74, controlled by the controller 66, selectively delivers a packaging device 76 to the conveyor 58. The packaging device 76 may include, for example, an envelope, a cover, a jacket, a product protection device, a poly wrapper, a paper wrapper, a band of material, a carton, a box, a tab, and like arrangements. The packaging device 76 can fully or partially cover or surround a respective product 54. The controller 66 signals feeder 74 to deliver a packaging device 76 onto the conveyor 58 according to the predetermined order, and the packaging device 76 is positioned in a gap between the products 62 that is created upstream of the feeder 74.

As the first stream of products 54, with or without the insert, travels along the conveyor 50, at point 80 the products 54 are moved or merged by a pusher 78 onto the conveyor 58. The controller 66 controls the pusher 78 to merge products 54 into the second stream of products 62 based on the predetermined order. While product 54 is merged onto conveyor 58, the pusher 78 selectively pushes the product 54, with or without the insert, into the waiting packaging device 76 at point 82, forming a packaged product 86. The packaged products 86 and products 54, 62 continue to travel as a single stream of products on the conveyor 58 downstream of point 82.

Downstream of point 82, the products 54, 62, and packaged products 86 are conveyed to an optional inkjet printer 88 for printing address or other indicia on the packaging device 76, product, or insert. The products 54, 62, and packaged products 86 are then conveyed to a conventional stacker 90 for further processing.

Figure 3:
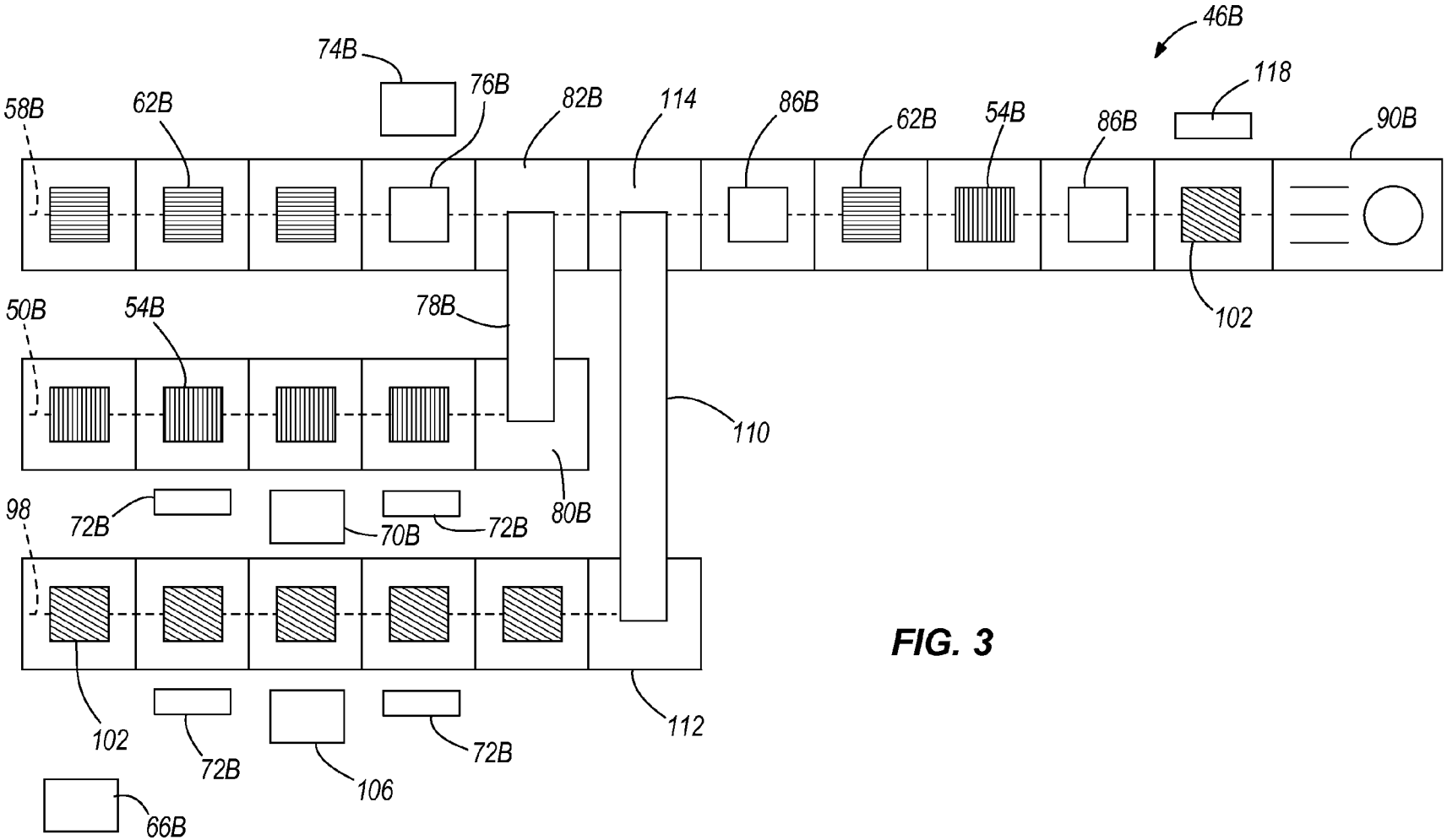
FIG. 3 is a schematic of a process and apparatus embodying the invention.

Another embodiment of the apparatus is illustrated in FIG. 3. Common components are identified by the same reference number with an appended "B". The apparatus 46B includes the conveyor 50B that transports a first stream of products 54B, the conveyor 58B that transports a second stream of products 62B, and a third conveyor 98 that transports a third stream of products 102. The products 102 can include magazines, books, brochures, direct mail pieces, other printed products and the like. The products 54B, 62B, and 102 can be the same or different products, and the products within each stream can vary.

The apparatus 46B includes the controller 66B, which receives an electronic file, e.g., mailing or sequence list, of all recipients of the products 54B, 62B, and 102. The electronic The electronic file is generated from combining the mailing lists of each stream of products 54B, 62B, and 102. The electronic file is in a predetermined order, such as zip code order or other address-related order.

The feeder 70B, under control of the controller 66B, is positioned near the conveyor 50B to selectively feed an insert onto the conveyor 50B. The insert is matched to the appropriate product 54B, and both insert and product 54B travel together down the conveyor 50B. A feeder 106 is positioned near the conveyor 98 to selectively feed an insert onto the conveyor 98. The controller 66B transmits a signal to the feeder 98 to selectively feed the insert according to the predetermined order.

The apparatus 46B can include an inkjet printer 72B upstream and/or downstream of the feeders 70B, 106. The inkjet printer 72B can selectively print address or other indicia on the products 54B, 102 and/or inserts.

The apparatus 46B includes a feeder 74B positioned near the conveyor 58B. The feeder 74B, controlled by the controller 66B, selectively delivers a packaging device 76B to the conveyor 58B. The controller 66B signals feeder 74B to deliver a packaging device 76B onto the conveyor 58B according to the predetermined order, and the packaging device 76B is positioned in a gap between the products 62B that is created upstream of the feeder 74B.

The apparatus 46B includes a pusher 78B. As the products 54B travel along the conveyor 50B, at point 80B, the products, with or without an insert, are moved or merged onto the conveyor 58B. The controller 66B controls the pusher 78B to merge products 54B into the second stream of products 62B based on the predetermined order. While product 54B is merged onto conveyor 58B, the pusher 78B selectively pushes the product 54B, with or without the insert, into the waiting packaging device 76B at point 82B, forming a packaged product 86B.

The apparatus 46B includes a second pusher 110. As the products 102 travel along the conveyor 98, at point 112, the products, with or without the insert, are pushed or merged onto the conveyor 58B. Similarly, the controller 66B controls the pusher 110 to merge products 102 into the second stream of products 62B, which includes packaged products 86B (from the conveyor 50B), based on the predetermined order. While product 102 is merged onto the conveyor 58B, the pusher 110 selectively pushes the product 102, with or without the insert, into the waiting packaging device 76B at point 114, forming a packaged product 86B. The packaged products 86B and products 54B, 62B, and 102 continue to travel as a single stream of products on the conveyor 58B downstream of point 114.

Downstream of point 114, the products 54B, 62B, and 102 and packaged products 86B are conveyed to an optional inkjet printer 118 for adding address or other indicia on the packaging device 76B, product, or insert. The products 54B, 62B, and packaged products 86B are then conveyed to a conventional stacker 90B for further processing.

In other embodiments, the apparatus 46, 46B can include additional conveyors, feeders, and pushers to accommodate any number of streams of products. The apparatus 46, 46B can include additional packaging device feeders to selectively feed different types of packaging devices onto the conveyor. In addition, each packaging device feeder can be configured to feed different types of packaging devices onto the conveyor. The controller 66, 66B signals the packaging device feeder when to deliver a packaging device and the type of packaging device to deliver. The electronic file includes data indicating which products receive a packaging device and the type of packaging device.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. Various features and aspects of the invention are set forth in the following claims.

Various independent features and independent advantages of the invention are set forth in the following claims.

What is claimed is:

1. A process to merge a plurality of streams of printed products, the process comprising:

merging a first stream of printed products with a second stream of printed products according to a predetermined order; and packaging selected printed products from the first stream while the printed products of the first stream are being merged with the second stream, wherein the predetermined order is recipient-based.

2. The process of claim 1, further comprising merging a mailing list of the first stream of printed products and a mailing list of the second stream of printed products.

3. The process of claim 1, wherein the recipient-based predetermined order is address-based.

4. The process of claim 1, wherein each selected printed product in the first stream comprises a bound book and an insert.

5. The process of claim 1, wherein packaging selected printed products in the first stream comprises pushing the printed product into a packaging device.

6. The process of claim 5, wherein the packaging device is at least one of a poly wrapper, a paper wrapper, a band of material, a carton, a box, an envelope, and a tab.

7. A process for combining streams of printed products, the process comprising:

generating a first stream of printed products in a first path;

generating a second stream of printed products in a second path;

using recipient-based information to selectively feed a packaging device onto the second path that corresponds to a selected printed product in the first path; and merging the first stream and the second stream wherein the selected printed product from the first stream is positioned into the respective packaging device.

8. The process of claim 7, wherein the packaging device is at least one of a poly wrapper, a paper wrapper, a band of material, a carton, a box, an envelope, and a tab.

9. The process of claim 7, further comprising creating a gap between selected printed products of the second stream, wherein the packaging device is fed into the gap.

10. The process of claim 7, further comprising providing an insert feeder on the first path and feeding inserts from the insert feeder to be matched with selected printed products of the first stream on the first path.

11. The process of claim 7, further comprising creating an intermixed stream of unpackaged printed products from the first stream, unpackaged printed products from the second stream, and packaged printed products from the first stream.

* * * * *